US006095624A

United States Patent [19]

Wilbert

[11] Patent Number: 6,095,624

[45] Date of Patent: Aug. 1, 2000

[54] TICKET DISPENSER

[75] Inventor: Stephen J. Wilbert, North Kingstown, R.I.

[73] Assignee: Scope Display and Box Company, Cranston, R.I.

[21] Appl. No.: 09/059,550

[22] Filed: Apr. 13, 1998

[51] Int. Cl.[7] ..... B65H 35/00

[52] U.S. Cl. ..... 312/34.7; 312/34.23; 312/293.3

[58] Field of Search ..... 312/109, 111, 312/34.4, 34.7, 34.18, 34.23, 293.3, 216; 206/39, 39.6, 39.7; 225/39, 42, 43, 53, 90

[56] References Cited

U.S. PATENT DOCUMENTS

| | | | |
|---|---|---|---|
| D. 319,264 | 8/1991 | Schafer . | |
| D. 329,877 | 9/1992 | Schafer . | |
| 978,052 | 12/1910 | Oehring . | |
| 2,447,409 | 8/1948 | Gulow | 312/328 |
| 2,626,196 | 1/1953 | Sides | 312/328 |
| 2,655,424 | 10/1953 | O'Conner | 312/328 |
| 2,803,512 | 8/1957 | Band | 312/216 X |
| 3,517,448 | 6/1970 | Wallace | 312/34.23 X |
| 4,274,573 | 6/1981 | Finkelstein . | |
| 4,858,806 | 8/1989 | Schafer . | |
| 4,995,507 | 2/1991 | Schafer . | |
| 5,100,038 | 3/1992 | Schafer . | |
| 5,111,939 | 5/1992 | Schafer . | |
| 5,240,195 | 8/1993 | Klaassen et al. . | |
| 5,287,980 | 2/1994 | Saltz . | |
| 5,372,415 | 12/1994 | Tisbo et al. | 312/108 |
| 5,399,005 | 3/1995 | Schafer | 312/109 X |
| 5,492,398 | 2/1996 | Schafer | 312/34.7 |
| 5,538,159 | 7/1996 | Snyder et al. | 312/326 X |
| 5,738,424 | 4/1998 | Katz et al. | 312/293.3 |

FOREIGN PATENT DOCUMENTS

| | | | |
|---|---|---|---|
| 284687 | 1/1965 | Netherlands | 312/293.5 |

*Primary Examiner*—Peter M. Cuomo
*Assistant Examiner*—Hanh V. Tran
*Attorney, Agent, or Firm*—Salter & Michaelson

[57] ABSTRACT

A ticket dispenser includes a box-like structure having a pair of side walls, top and bottom walls, a front wall and an open back. The structure has a plurality of vertical and horizontal interior walls secured to the side, top, bottom and front walls of the structure. The side, top, bottom, front and interior walls of the structure define a plurality of box-shaped compartments each having respective side, top, bottom and front walls and being adapted to receive series connected tickets therein. The display further comprises a plurality of doors, one for each compartment. Each door is releasably and hingedly connected to the bottom wall of the compartment. A locking assembly releasably locks each door to the structure. Preferably, each door has an elongate slot formed in the body for receiving the tickets therethrough. The elongate slot extends in a first direction, e.g., horizontally. The door further includes an elongate opening formed in the body in communication with the slot. The elongate opening extends in a second direction generally perpendicular to the first direction, e.g., vertically.

17 Claims, 5 Drawing Sheets

TICKET DISPENSER

BACKGROUND OF THE INVENTION

This invention relates generally to displays and dispensers, and more particularly to a dispenser used to display and dispense tickets, such as lottery tickets.

Lottery ticket dispensers are well known in the art. Reference can be made to any of the U.S. Pat. Nos. Des. 319,264, Des. 329,877, U.S. Pat. Nos. 4,858,806, 4,995,507, 5,100,038 and 5,111,939, all to Schafer, as representative prior art in this field. Of these patents, U.S. Pat. No. 5,111,939 (the '939 patent) is the most pertinent.

The '939 patent discloses a box-like display and dispensing unit capable of being stacked with other identically constructed units. Each unit has a front wall, a top wall, a bottom wall, opposite side walls and an opening created by the top, bottom and side walls at the rear of the unit. A cover is hingedly connected to the side walls adjacent the bottom wall for moving between an open position in which the cover swings away from the opening and a closed position in which the cover blocks the opening. A horizontal slot is formed in the cover through which tickets are dispensed. A pair of horizontally disposed rollers, each positioned adjacent the slot, are rotatably attached to the cover for enhancing the dispensing of tickets from the unit. The cover is further provided with a key lock cylinder for locking the cover in its closed position to the top wall of the unit.

While the unit described in the '939 patent is generally effective for its intended purpose, it does suffer from several shortcomings. First of all, it is difficult when the cover is locked in place in its closed position to manipulate tickets contained within the unit without opening the cover. Second, the rollers are ineffective in applying sufficient pressure on the ticket extending therethrough to prevent the ticket from moving backwards through the slot and into the unit. Thirdly, when placing units in stacked relation, the opening of the cover of one unit obstructs the cover and tickets of the unit located directly below the unit.

The foregoing illustrates limitations known to exist in present lottery ticket dispensers. Thus, it is apparent that it would be advantageous to provide an improved dispenser directed to overcoming one or more of the limitations set forth above. Accordingly, a suitable alternative is provided including features more fully disclosed hereinafter.

SUMMARY OF THE INVENTION

In general, the present invention is directed to a ticket dispenser comprising a box-like structure having a pair of side walls, top and bottom walls, a front wall and an open back. The structure has a plurality of vertical and horizontal interior walls secured to the side, top, bottom and front walls of the structure. The side, top, bottom, front and interior walls of the structure define a plurality of box-shaped compartments each having respective side, top, bottom and front walls and being adapted to receive series connected tickets therein. The display further comprises a plurality of doors, one for each compartment. Each door is releasably and hingedly connected to the bottom wall of the compartment wherein locking means releasably locks each door to the structure.

In another aspect of the invention, a ticket dispenser comprises a box-like structure as set forth above and a plurality of doors, one for each compartment, each door being attachable to a wall of the compartment and including a rectangular-shaped body having opposite side edges, a top edge, a bottom edge, and an elongate slot formed in the body for receiving the tickets therethrough. The elongate slot extends in a first direction, e.g., horizontally. The door further includes an elongate opening formed in the body in communication with the slot. The elongate opening extends in a second direction generally perpendicular to the first direction, e.g., vertically. Suitable means is provided for releasably locking each door to the structure.

Accordingly, among the several objects of the present invention are: the provision of a lottery ticket dispenser capable of displaying and dispensing a plurality of lottery tickets which are serially connected to one another; the provision of such a ticket dispenser having a plurality of compartments arranged in rows and columns and a plurality of uniquely configured doors, one for each compartment, each door enabling the user to manipulate tickets within the dispenser without opening the door; the provision of such a ticket dispenser in which the doors are completely removable from their respective compartments; the provision of such a ticket dispenser which is constructed for maintaining pressure on a ticket extending through a horizontal slot formed in the door; and the provision of such a ticket dispenser which is easy to operate.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

Corresponding reference numerals designate corresponding parts throughout the several views of the drawings.

DETAILED DESCRIPTION OF THE PREFERRED EMBODIMENTS

Figure 1:
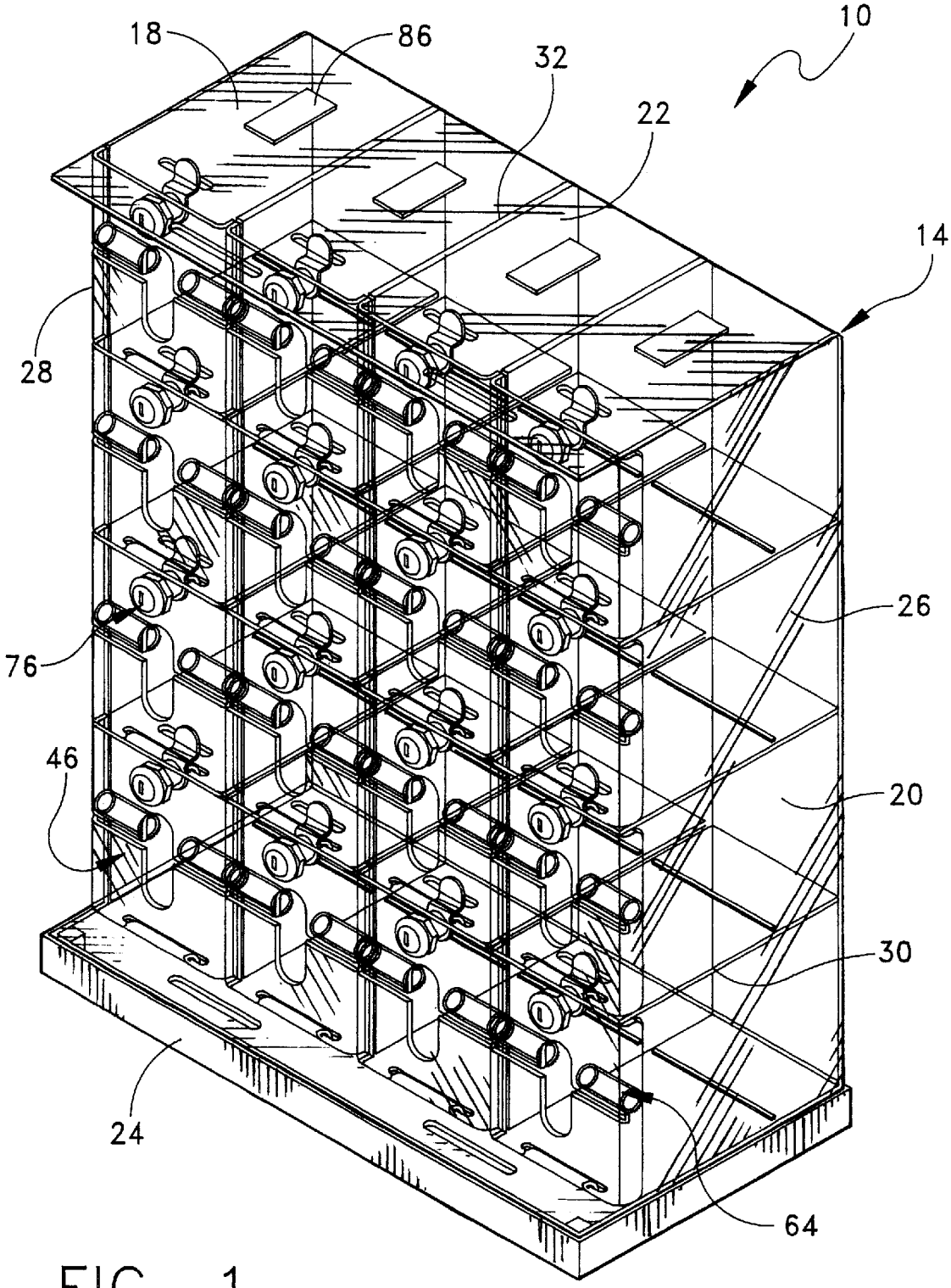
FIG. 1 is a rear perspective view of a lottery ticket dispenser of the present invention.

Referring generally to the drawings, and more particularly to FIG. 1, there is generally indicated at 10 a lottery ticket dispenser of the present invention. As shown, the ticket dispenser 10 is especially suited for displaying and dispensing several sets of serially connected lottery tickets 12 (not shown in FIG. 1 but illustrated in FIGS. 5 and 6) in a uniformed and controlled fashion. The ticket dispenser 10 is designed so that it solves many of the aforementioned problems associated with the prior art.

Figure 2:
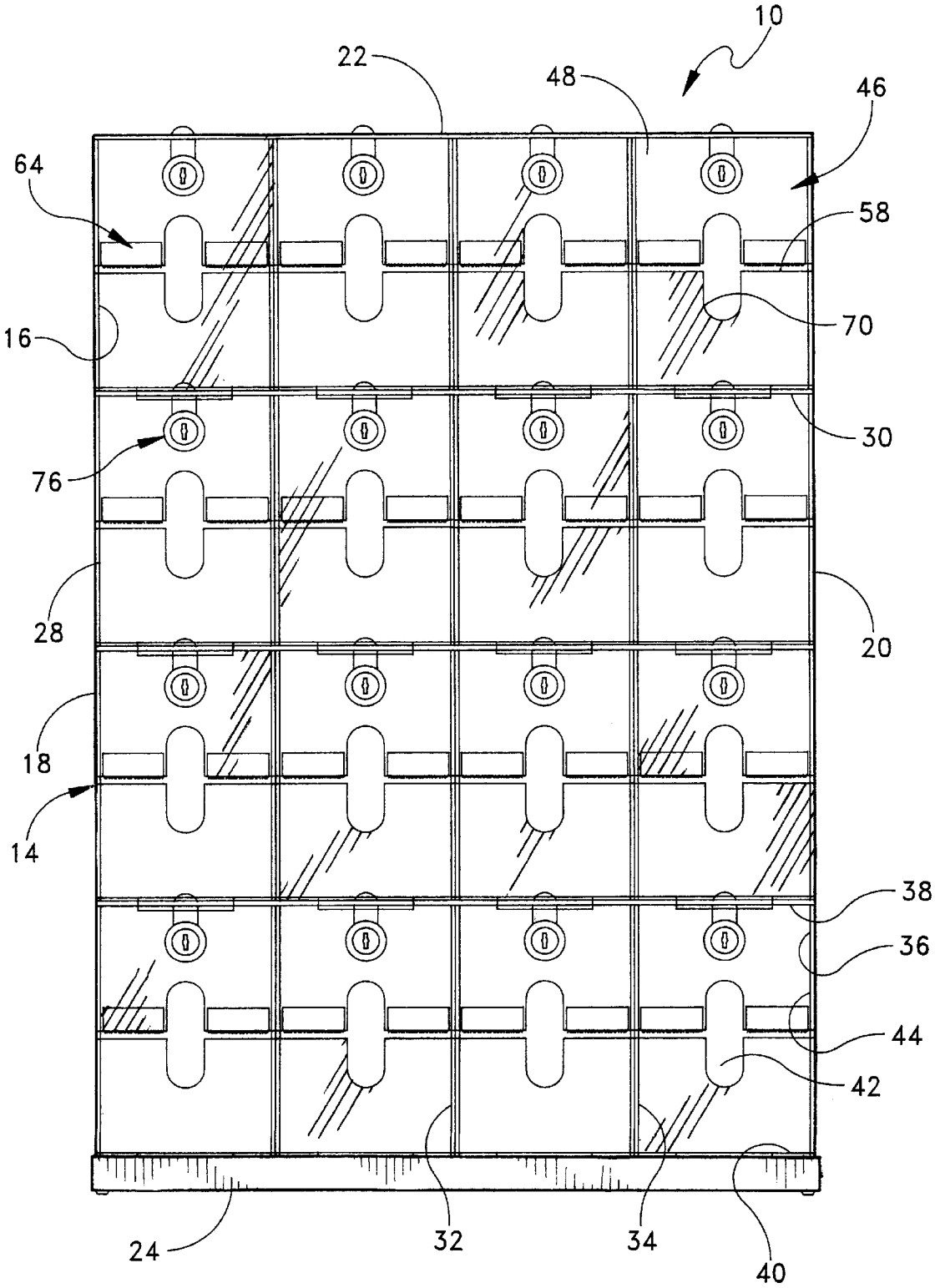
FIG. 2 is a rear elevational view thereof.

The ticket dispenser 10 comprises a box-like structure, generally indicated at 14, having a plurality of compartments 16 (FIG. 2), each being sized and configured for receiving a set of serially connected tickets 12. As illustrated in FIGS. 1 and 2, the structure 14 has sixteen compartments 16 arranged in four rows and four columns; however, it should be understood that the structure 14 can include any number of compartments 16 and still fall within the scope of the present invention.

Specifically, the structure 14 includes a pair of side walls 18, 20, a top wall 22, a base 24, a front wall 26 and an open back 28. The structure 14 further includes several horizontally disposed interior walls, each indicated at 30 and several vertically disposed interior walls, each indicated at 32, (e.g., three horizontal interior walls 30 and three vertical interior walls 32) which, together with the side walls 18, 20, the top wall 22, the base 24 and the front wall 26 create the aforementioned compartments 16. Each compartment 16 in turn has respective sides 34, 36, a top 38, a bottom 40 and a front 42, along with an opening 44 located at the back of the structure 14. Sets of lottery tickets 12 are deposited into the compartments 16 through these openings 44.

A plurality of doors, each generally indicated at 46, one for each compartment 16, are further provided for closing the compartments 16, thus securing the sets of lottery tickets 12 within the compartments 16. Each door 46 is releasably and hingedly connected to the bottom 40 of the compartment 16. Specifically, each door 46 includes a rectangular-shaped body 48 having opposite side edges 50, 52, a top edge 54 and a bottom edge 56 (see FIG. 3). The side edges 50, 52 are inwardly curved so that they extend within the sides 34, 36 of the compartment 16 when attaching the door 46 to the compartment. Each door 46 has a horizontal slot 58 formed centrally within the body 48 through which the set of tickets 12 are dispensed (see FIG. 5). This slot 58 is sufficiently wide to accommodate the thickness of a lottery ticket, but not too wide so that the set of tickets 12 can be removed therefrom.

Figure 3:
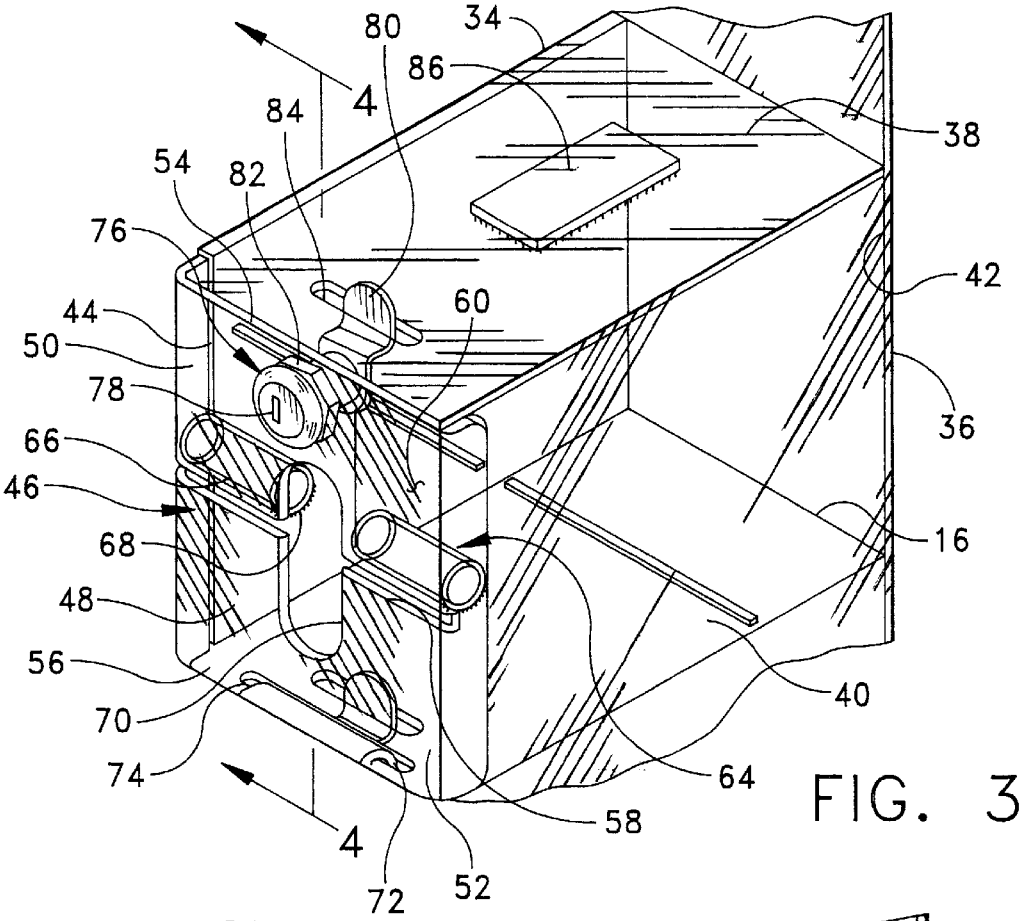
FIG. 3 is an enlarged rear perspective view of a compartment and a door of the ticket dispenser.
Figure 4:
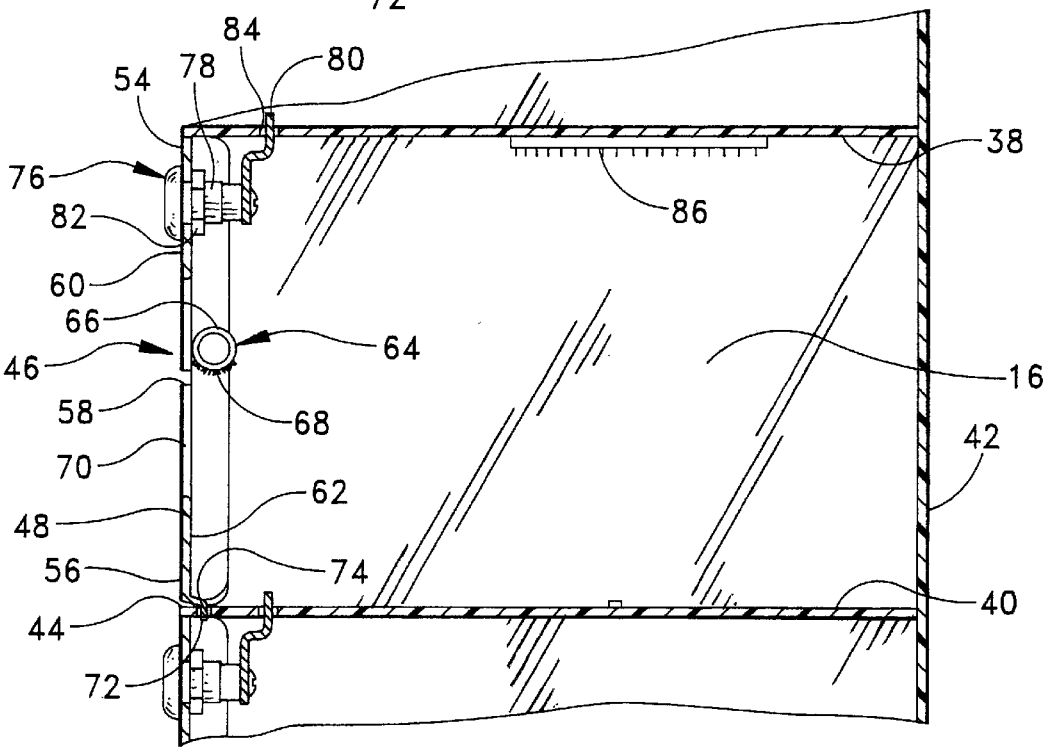
FIG. 4 is an enlarged side cross-sectional view of the compartment and door taken along line 4—4 in FIG. 3.
Figure 5:
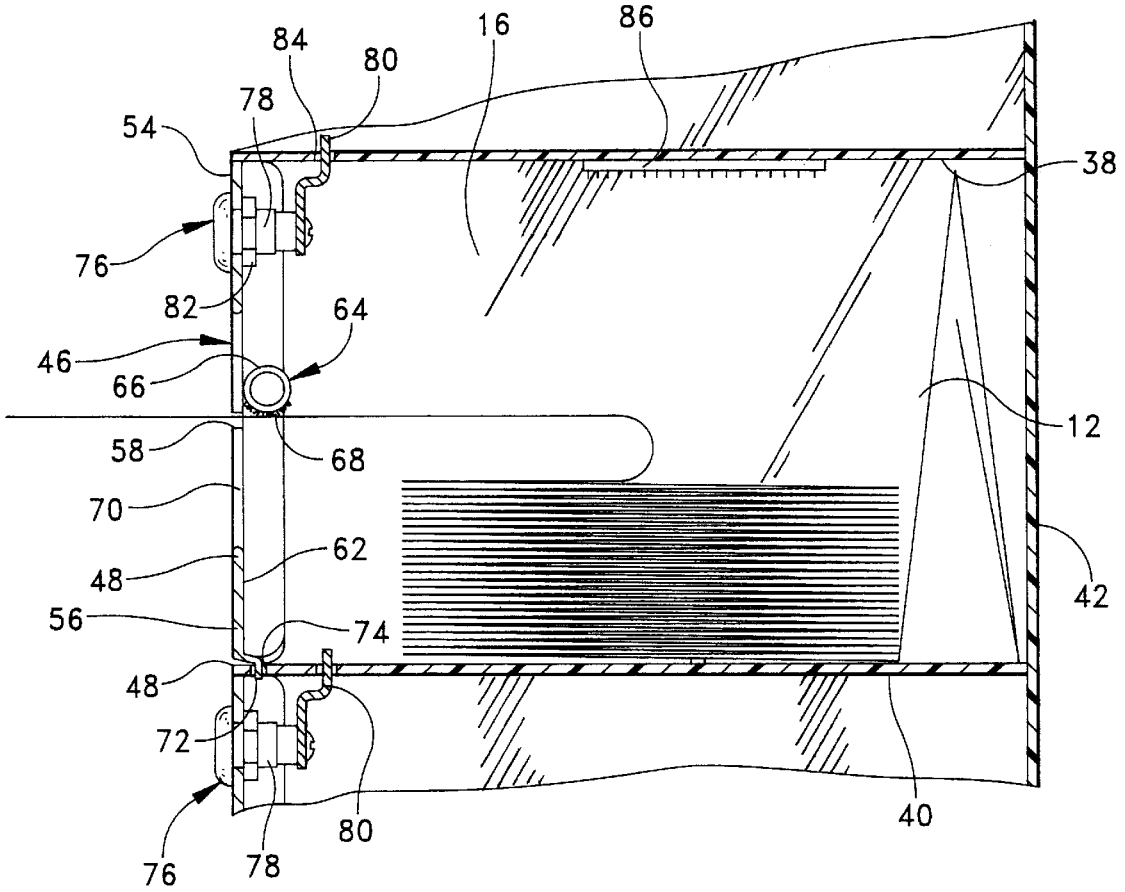
FIG. 5 is a cross-sectional view similar to FIG. 4 illustrating a set of serially connected lottery tickets disposed within the compartment and extending through a horizontal slot formed in the door covering the compartment.

Referring to FIGS. 3–5, each door 46 has opposing outwardly and inwardly facing surfaces 60, 62. The inwardly facing surface 62 has mounted therein a guide member generally indicated at 64 which is positioned adjacent and above the elongate slot 58 in a direction parallel thereto for guiding the movement of the set of series-connected tickets 12 through the slot 58. The guide member 64 includes a cylindrical body 66 and a strip 68 of hook and loop fastener material disposed on the outer surface of the body 66. The body 66 is secured to the inwardly facing surface 62 of the door 46 by any suitable means, such as high strength adhesive. As shown in FIG. 5, the strip 68 of hook and loop fastener material is disposed on the underside of the body 66 so that tickets engage the strip 68 prior to entering through and out of the elongate slot 58. Thus, the guide member 64 applies a slight amount of pressure on the tickets for preventing their unwanted movement backwards through the slot 58.

Also formed in the body 48 of each door 46 is a vertically oriented elongate opening 70 which communicates with the elongate slot 58 described above. As shown, the elongate opening 70 is centrally positioned with respect to the elongate slot 58 and somewhat wider than the slot 58. The purpose for the elongate opening 70 is for allowing a person to manipulate his or her fingers within the opening 70 in instances where the leading edge of the set of tickets 12 is required to be pulled through the slot 58. The elongate opening 70 is sufficiently wide to allow a person's forefinger and thumb to extend therethrough, but not the person's entire hand. The provision of the elongate opening 70 is a significant improvement over the prior art dispensers since many times the operator of an establishment having lottery ticket dispensers will not have access to the interior of the compartment. The elongate opening 70 allows limited access into the compartment 16 without the possibility of being able to remove the entire set of tickets 12.

Figure 6:
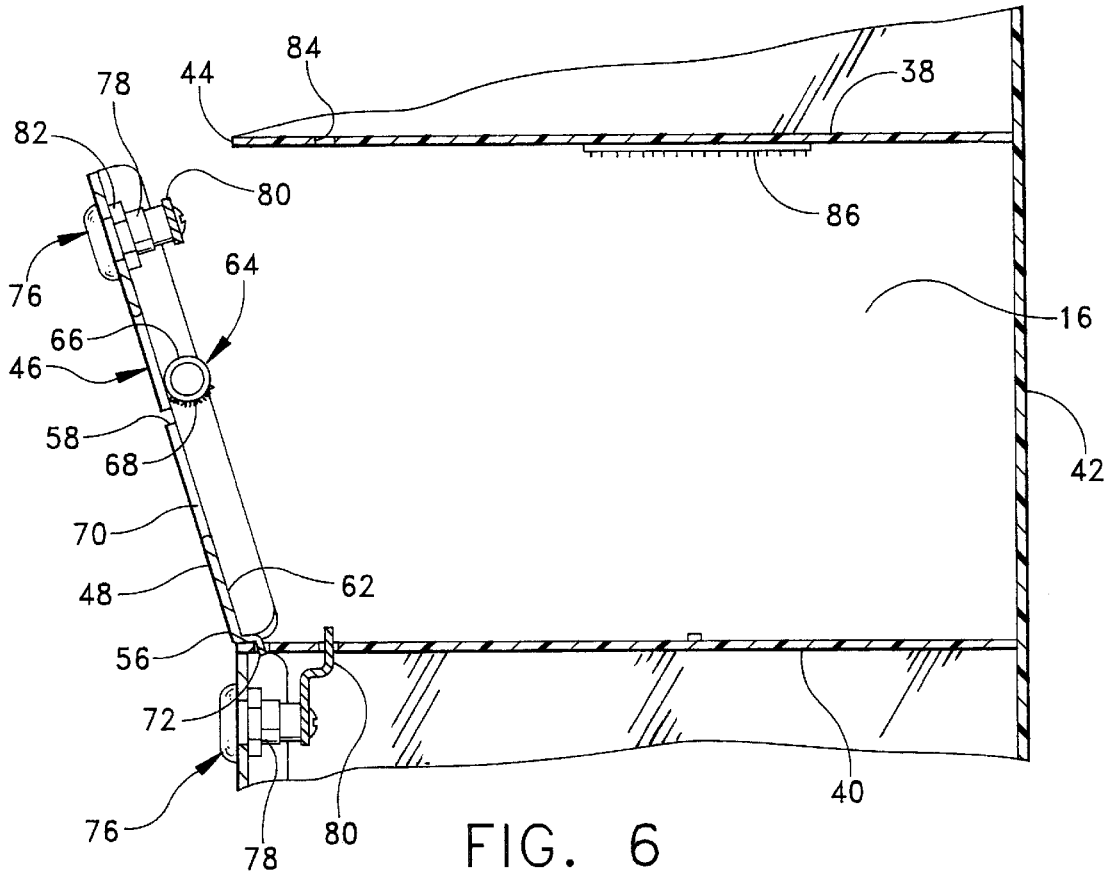
FIG. 6 is a cross-sectional view similar to FIGS. 4 and 5 illustrating the door being opened.
Figure 7:
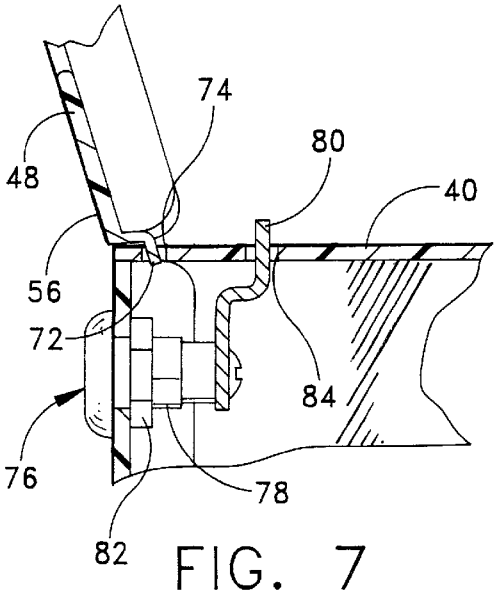
FIG. 7 is a further enlarged cross-sectional view of the hinged connection of the door to a bottom wall of the compartment.
Figure 8:
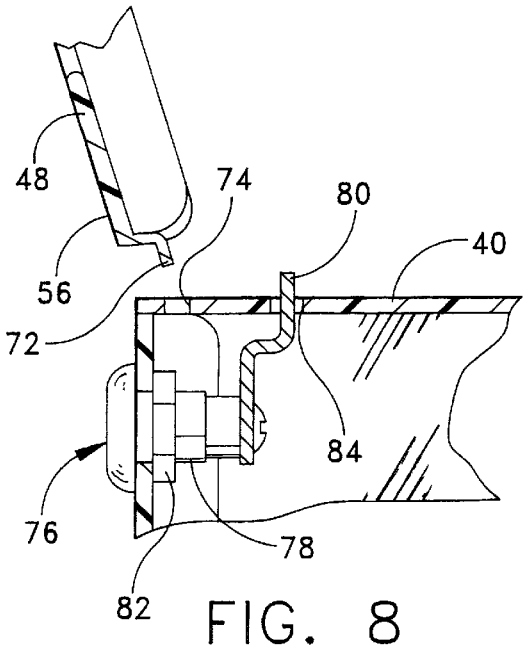
FIG. 8 is a cross-sectional view similar to FIG. 7 illustrating the door being removed from the bottom wall of the compartment.

Turning now to FIGS. 6–8, formed along the bottom edge 56 of each door 46 is a downwardly projecting flange 72 which is releasably received within an elongate aperture 74 formed in the bottom 40 of each compartment 16. As best illustrated in FIGS. 7 and 8, this flange 72 is inwardly off-set from the body 48 of the door 46 so that the body 48 lies along the plane of the opening 44 of the compartment 16. The attachment and removal of the doors 46 from the structure 14 will be described in greater detail as the description of the invention proceeds.

Still referring to FIGS. 6–8, each door 46 further includes a lock assembly, generally indicated at 76, for locking the door 46 to the structure 14. Each lock assembly 76 includes a key cylinder 78 which is mounted on the body 48 of the door 46 within an opening formed therein and a rotatable latch member 80 which is rotatably secured to the key cylinder 78. As shown, a nut fastener 82, threadably attached to the outer surface of the key cylinder 78, securely fastens the key cylinder 78 to the body 48 of the door 46. Such lock assemblies 76 are well known in the art.

The arrangement is such that a key (not shown) inserted into the key cylinder 78 can rotate the latch member 80 between an unlocked position (FIG. 6) in which the door 46 can be released from the structure 14 and a locked position in which the latch member 80 extends through an aperture 84 formed in the top 38 of the compartment for locking the door thereto. With the flange 72 extending through the aperture 74 in the bottom 40 of the compartment 16 and the latch member 80 extending through the top 38 of the compartment 16, the door 46 cannot be removed from the structure 14. Only by rotating the latch member 80 with a suitable key so that it is removed from the aperture 84 can the door be pivoted about the flange 72 in the manner depicted in FIGS. 6 and 7. Once pivoted, the door 46 can be completely removed from the bottom 40 of the structure in the manner illustrated in FIG. 8. This complete removal of the door 46 enables complete access within the compartment 16 which heretofore has been difficult with prior art dispensers.

It should be understood that the flange 72 can be located along the top edge 54 of each door 46 and that the lock assembly 76 along the bottom edge 56 thereof and still fall within the scope of the present invention. By providing the flange 72 along the bottom edge 56 allows the door 46 to pivot in the manner depicted in FIGS. 6–8 whereas if the door 46 were pivoted along the top edge 54 thereof, it would have a tendency to fall away from the structure 14 in an undesirable manner.

Preferably, the box-like structure 14 and the doors 46 are fabricated from transparent, high impact thermoplastic material having a sufficient strength and rigidity to prevent tampering with the structure. The transparent nature of the structure 14 allows the sets of lottery tickets 12 to be viewed along the front of the dispenser 10.

Referring back to FIGS. 3–6, each compartment 16 further includes a strip of hook material 86 disposed on the upper wall thereof. The hook material engages the upper edge of the lottery tickets 12 when mounted in the compartment 16 so that the tickets 12 will remain upright and facing the front wall 42 of the compartment (See FIG. 5).

It can therefore be seen that for these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A ticket dispenser comprising:

a unitary box-like structure having a pair of side walls, top and bottom walls, a front wall and an open back, said structure having a plurality of vertical and horizontal interior walls secured to the side, top, bottom and front walls of the structure, said side, top, bottom, front and interior walls defining a plurality of box-shaped compartments arranged in vertical and horizontal rows, each box-shaped compartment having respective side, top, bottom and front walls and wherein adjacent vertical compartments have a shared wall including at least one of their top or bottom walls with an adjacent vertical box-shaped compartment, each compartment further being adapted to receive series connected tickets therein;

a plurality of doors, one for each of the plurality of compartments, each of said doors being releasably and hingedly connected to the bottom wall of their corresponding compartment; and a plurality of locking members, one for each of the plurality of doors, each locking member including a rotatable latch member rotatably movable between an unlocked position in which the door can be released from the structure and a locked position in which the latch member extends through an aperture formed in the top wall of the compartment thereby locking the door to the shared wall of the adjacent vertical compartment.

2. The ticket dispenser as set forth in claim 1, the bottom wall of each compartment including an elongate aperture formed therein, each said door including a rectangular-shaped body having opposite side edges, a top edge and a bottom edge with a downwardly projecting flange which is releasably received within said elongate aperture so as to releasably secure each door to its corresponding compartment so that each door can be completely removed from the ticket dispenser.

3. The ticket dispenser as set forth in claim 2, said flange being inwardly off-set from the body of the door.

4. The ticket dispenser as set forth in claim 1, each door including a rectangular-shaped body having opposite side edges, a top edge, a bottom edge, and an elongate slot formed in the body for receiving said tickets therethrough, said elongate slot extending in a first direction.

5. The ticket dispenser as set forth in claim 4, each said door having opposing outwardly and inwardly facing surfaces, said inwardly facing surface having mounted thereon a guide member positioned adjacent said elongate slot for guiding the movement of the series-connected tickets through the slot.

6. The ticket dispenser as set forth in claim 5, said guide member having a cylindrical body.

7. The ticket dispenser as set forth in claim 6, said cylindrical body of the guide member having a strip of hook and loop fastener material disposed on its outer surface.

8. The ticket dispenser as set forth in claim 4, each door further having an elongate opening formed therein in communication with the slot, said elongate opening extending in a second direction generally perpendicular to said first direction.

9. The ticket dispenser as set forth in claim 1, said locking member further comprising a key cylinder fixedly secured to the door and rotatably secured to the latch member, said key cylinder being adapted to receive a key for rotating the latch member.

10. A ticket dispenser comprising:

a unitary box-like structure having a pair of side walls, top and bottom walls, a front wall and an open back, said structure having a plurality of vertical and horizontal interior walls secured to the side, top, bottom and front walls of the structure, said side, top, bottom, front and interior walls defining a plurality of box-shaped compartments arranged in vertical and horizontal rows, each box-shaped compartment having respective side, top, bottom and front walls and wherein adjacent vertical compartments share at least one of their top or bottom walls with an adjacent vertical box-shaped compartment, each compartment further being adapted to receive series connected tickets therein;

a plurality of doors, one for each compartment, each said door being attachable to the bottom wall of the compartment and including a rectangular-shaped body having opposite side edges, a top edge, a bottom edge, an elongate slot formed in the body for receiving said tickets therethrough, said elongate slot extending in a first direction, and an elongate opening formed in the body in communication with the slot, said elongate opening extending in a second direction generally perpendicular to said first direction; and means for releasably locking each door to the structure by engaging an aperture formed in the shared top wall of the adjacent vertical compartment.

11. The ticket dispenser as set forth in claim 10, the bottom wall of each compartment including an elongate aperture formed therein, each said door further including a downwardly projecting flange formed along the bottom edge thereof, said flange being releasably received within said elongate aperture so as to releasably secure each door to its corresponding compartment so that each door can be completely removed from the ticket dispenser.

12. The ticket dispenser as set forth in claim 11, said flange being inwardly off-set from the body of the door.

13. The ticket dispenser as set forth in claim 10, each said door having opposing outwardly and inwardly facing surfaces, said inwardly facing surface having mounted thereon a guide member positioned adjacent said elongate slot for guiding the movement of the series-connected tickets through the slot.

14. The ticket dispenser as set forth in claim 13, said guide member having a cylindrical body.

15. The ticket dispenser as set forth in claim 14, said cylindrical body of the guide member having a strip of hook and loop fastener material disposed on its outer surface.

16. The ticket dispenser as set forth in claim 10, said means for releasably locking each door to the structure comprising a rotatable latch member rotatably movable between an unlocked position in which the door can be released from the structure and a locked position in which the latch member extends through said aperture formed in the top wall of the compartment for locking the door thereto.

17. The ticket dispenser as set forth in claim 16, said means for releasably locking each door to the structure further comprising a key cylinder fixedly secured to the door and rotatably secured to the latch member, said key cylinder being adapted to receive a key for rotating the latch member.

* * * * *